US005105971A

United States Patent [19]

Hertenstein et al.

[11] Patent Number: 5,105,971

[45] Date of Patent: Apr. 21, 1992

[54] CARTON

[75] Inventors: Thomas H. Hertenstein, Cincinnati; Marcella S. Stevens; Harold R. Hartsel, both of Franklin, all of Ohio

[73] Assignee: American Packaging Corporation, Philadelphia, Pa.

[21] Appl. No.: 760,992

[22] Filed: Sep. 17, 1991

[51] Int. Cl.[5] ..... B65D 90/04

[52] U.S. Cl. ..... 220/461; 229/149; 229/152; 229/225

[58] Field of Search ..... 206/607, 606, 614, 609, 206/615; 229/128, 149, 152, 142, 225

[56] References Cited

U.S. PATENT DOCUMENTS

| | | | |
|---|---|---|---|
| 2,348,377 | 5/1944 | Goodyear | 206/607 |
| 3,113,666 | 12/1963 | Will | 206/607 |
| 3,927,821 | 12/1975 | Dunning | 220/461 |
| 4,111,297 | 9/1978 | Paulin | 206/606 |
| 4,380,289 | 4/1983 | Bigelow | 206/606 |
| 4,941,755 | 7/1990 | Cazes | 220/461 |
| 4,986,420 | 1/1991 | Gunn et al. | 206/607 |

FOREIGN PATENT DOCUMENTS

| | | | |
|---|---|---|---|
| 736811 | 6/1966 | Canada | 206/607 |
| 2031385 | 4/1980 | United Kingdom | 206/607 |

*Primary Examiner*—Stephen Marcus
*Assistant Examiner*—Christopher J. McDonald
*Attorney, Agent, or Firm*—Frank A. Follmer

[57] ABSTRACT

A reclosable container having a box-like configuration is provided with means for severing the front and side walls thereof along a strip spaced below the upper end thereof for defining a hinge portion in the back wall end to divide the carton into a lid and a base.

7 Claims, 7 Drawing Sheets

FIG. 4A
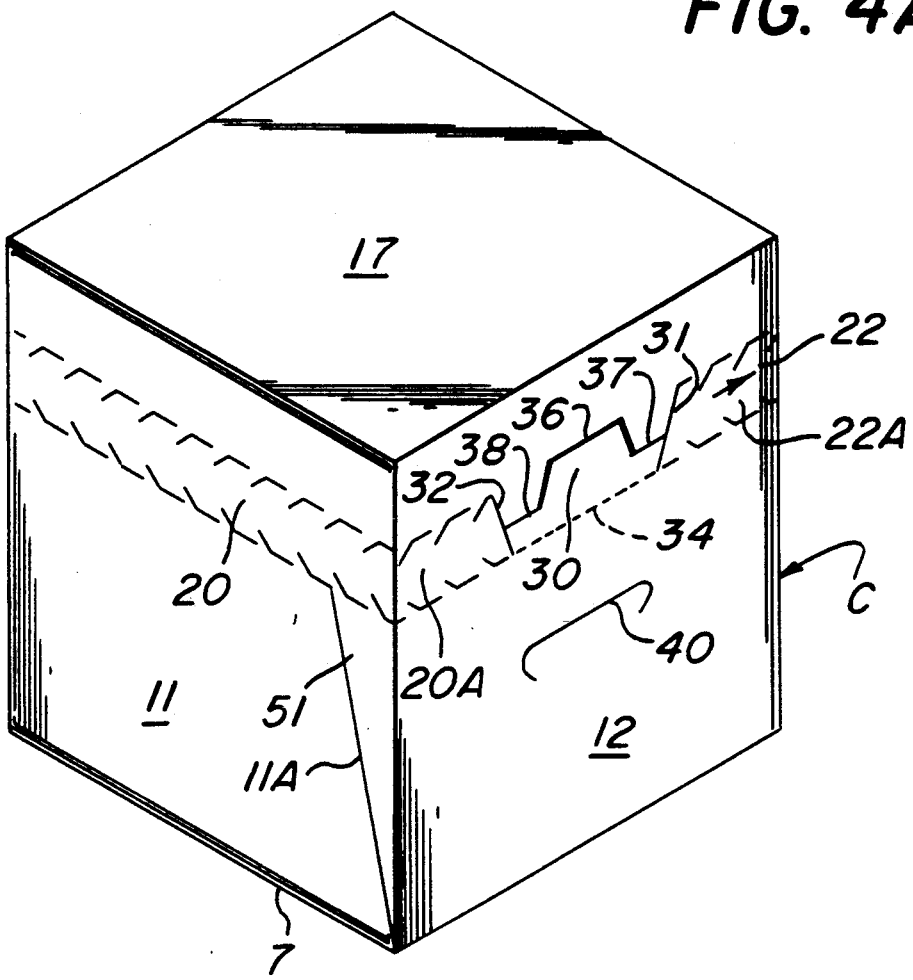
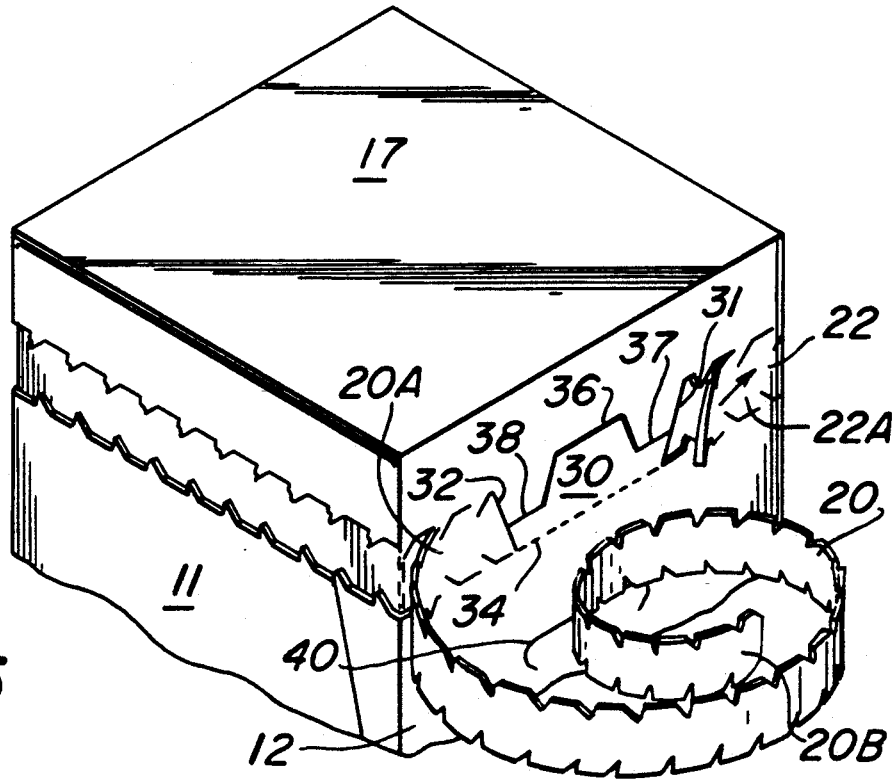
FIG. 5

FIG. 6
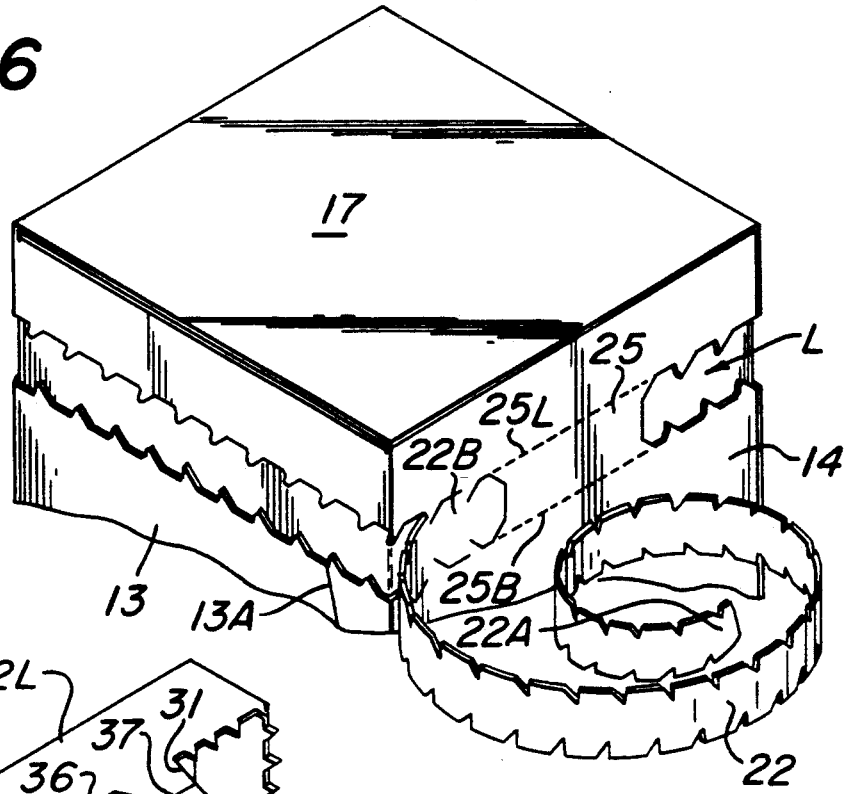
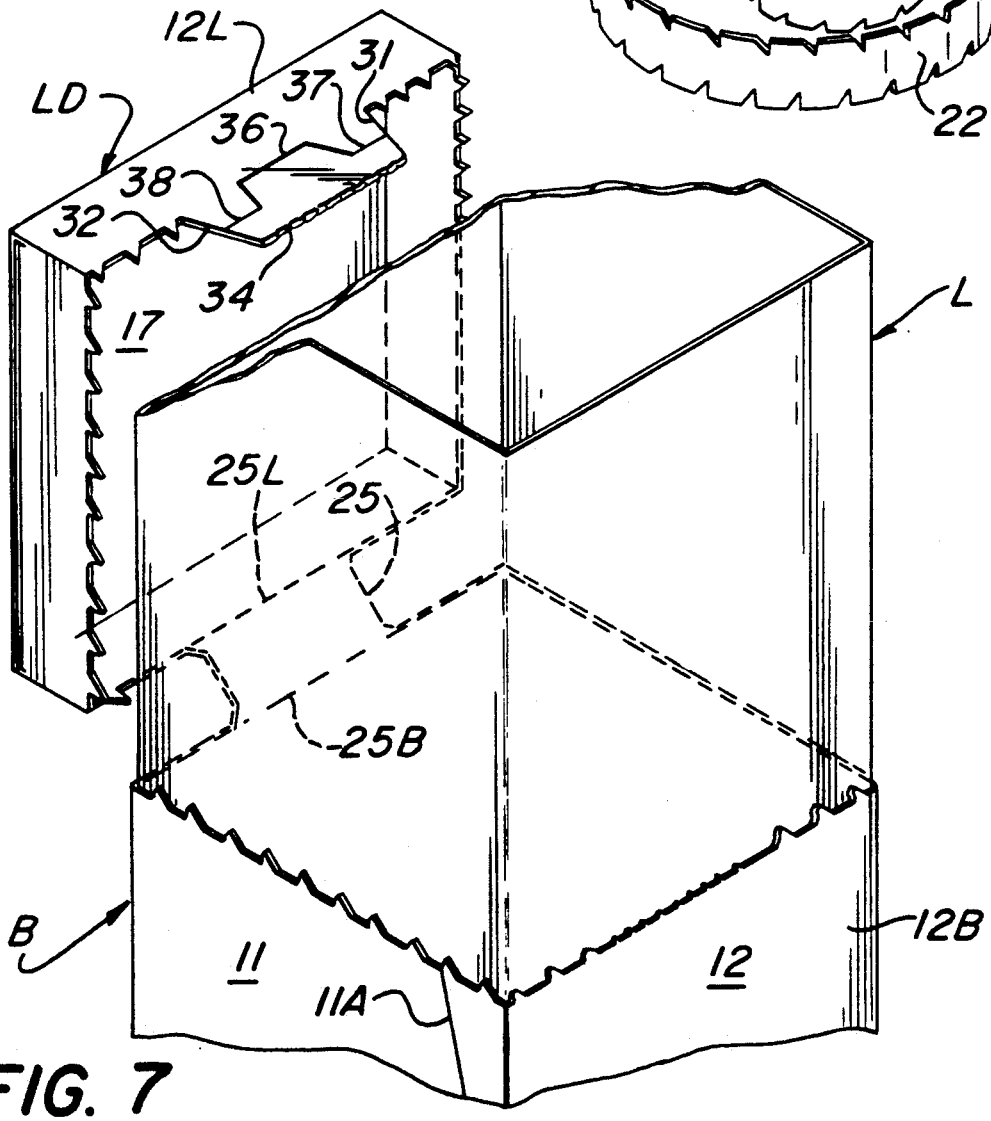
FIG. 7

FIG. 9
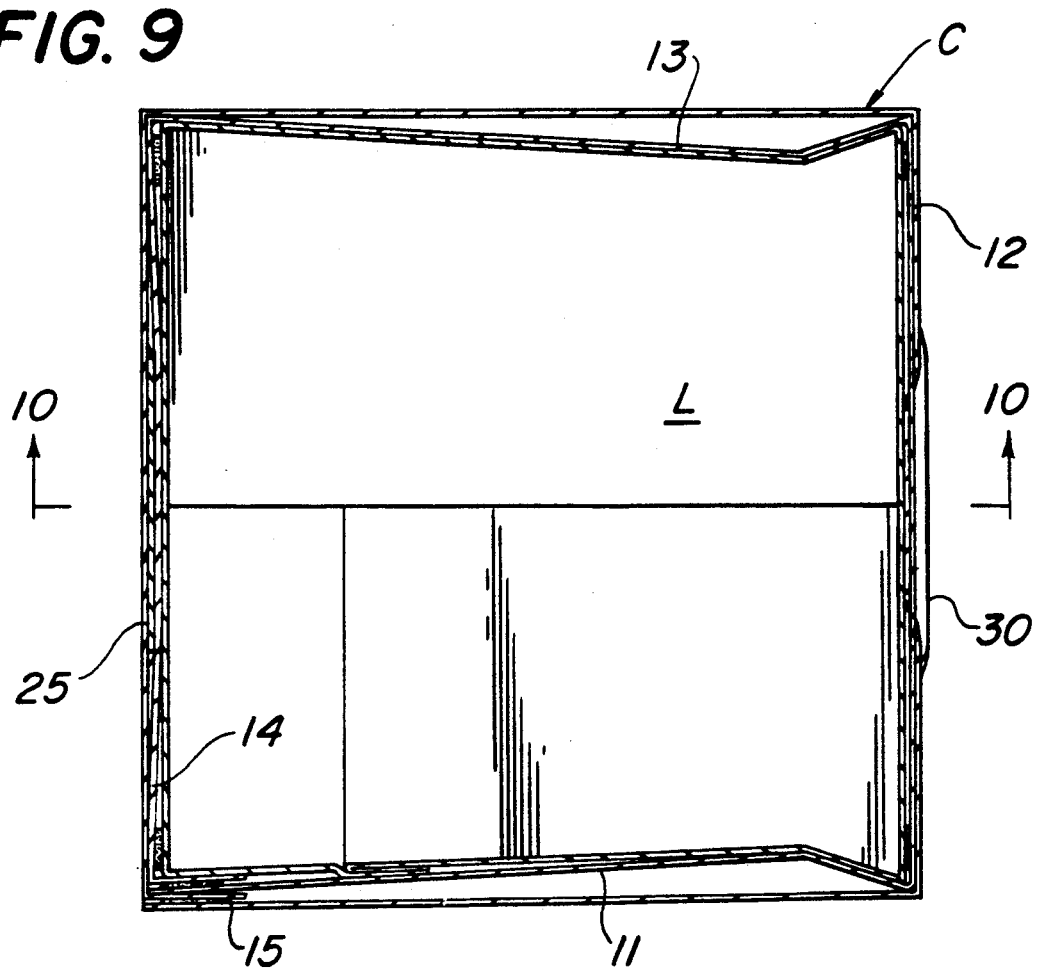
FIG. 10
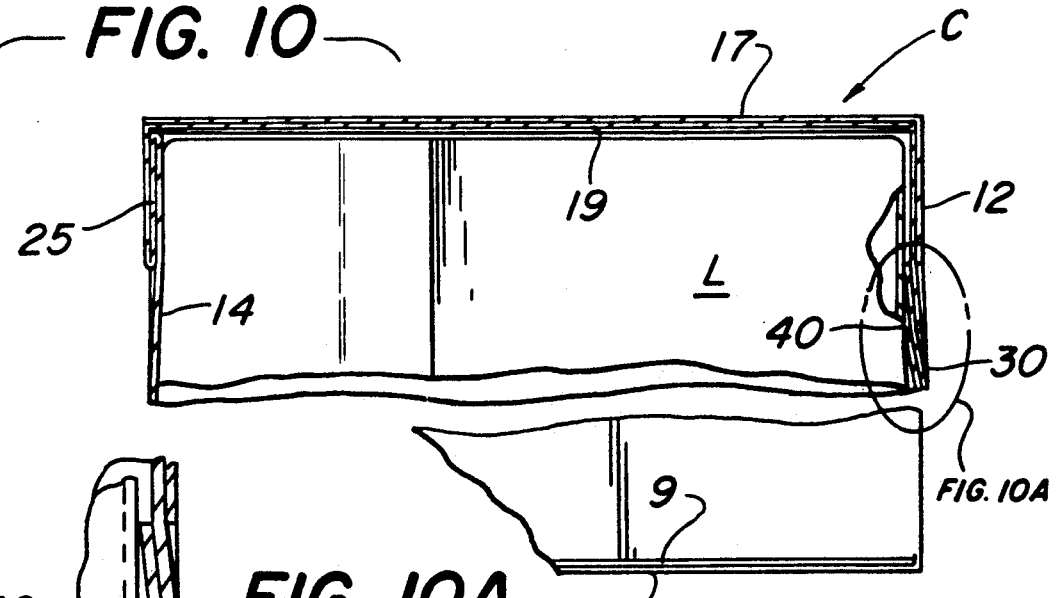
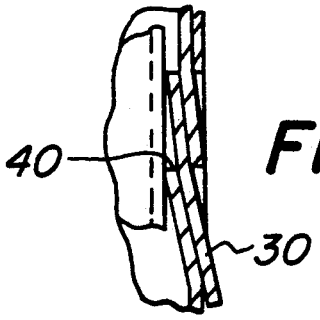
FIG. 10A

CARTON

BACKGROUND OF THE INVENTION

1. Field of the Invention

This invention relates to the field of carton-type containers of the paperboard or boxboard type which may be provided with a sealing liner means for protecting the contents of the container.

2. Description of the Prior Art

Numerous forms of cartons have been provided for protecting the contents thereof, such as, by a sealed liner means. Where a relatively high degree of protection is required, as where the unused contents must be protected from the atmosphere, either because the contents are moist and must be prevented from drying out or where the contents are essentially dry but are susceptable to absorption of moisture from the atmosphere, it is customary to provide a liner which will provide the desired degree of moisture/vapor-proofness. Where a liner is utilized, it is of course necessary to open both the outer carton and the liner, which allows the contents to be dispensed, after which the liner and outer carton must be reclosed in some manner to continue to protect the remaining contents of the container. Some produsts of this type are particularly difficult to package in reusable types of containers. Thus, for example, the packages of the premeasured coffee filters and the alcohol-based wipes for babies are particularly difficult to package. Typically, the prior art employs either a package having a polyethylene lid with a foil overwrap on the paperwrap, or a wound paperwrap base with a metal bottom, which packages are often made of multiple pieces and are extremely difficult to separate. This type of container presents serious problems of disposal in an environmentally safe manner because the types of products used and the difficulties in separating the products for separate recycling.

SUMMARY OF THE INVENTION

It is the general object of the invention to provide a reclosable carton of the indicated type which is made of materials and is constructed so that it is disposable in an environmentally safe manner. Briefly stated, the container in accordance with the invention comprises a reclosable carton having a box-like configuration and, if desired, including an outer carton of a paperboard material and a separable inner liner for sealing the contents of the container. The outer carton has a box-like configuration comprising front and back walls in opposed relation, and a pair of side walls in opposed relation. The walls are provided with bottom closure flaps and top closure flaps for forming the bottom and tops of the carton. In accordance with the novel feature of the invention, means are provided for severing the front and end walls along a strip spaced below the upper ends thereof and for defining a hinge portion in the back wall to divide the carton into a lid comprising the top of the carton and the upper portions of the walls and a base comprising the bottom of the carton and the lower portions of the walls. The lid is hingedly connected to the back wall by the hinge portion for movement toward and away from the base for use in opening the top of the carton after the contents have been dispensed and the carton is to be stored for subsequent use.

Thus, it is apparent that the container in accordance with the invention is capable of being opened and then being reclosed for subsequent use. Further, by attaching the liner to the outer carton in a manner to permit ease of separation for the separate disposal thereof, the container is environmentally friendly. Furthermore, the lid is still attached to the carton by the hinge portion during the opening and use of the carton so that the product integrity is maintained at all times in preparation for a subsequent reclosure. Furthermore, the hinge portion allows the lid to be moved to a fully opened position providing good access to the liner which is supported on the base. Further, in accordance with another feature of the invention there is provided a reclosure tab on the lid which is adapted to be engaged with the base to lock the carton in its closed position.

BRIEF DESCRIPTION OF THE DRAWINGS

FIGS. 4A and 4B are perspective views of a completed carton in accordance with the invention.

FIGS. 5, 6 and 7 are views illustrating the manner in which the carton is opened to gain access to the contents thereof.

FIG. 9 is a section taken on line 9—9 of FIG. 8.

FIG. 10 is a section taken on line 10—10 of FIG. 9.

FIG. 10A is an enlarged view of a detail in FIG. 10.

DETAILED DESCRIPTION OF THE PREFERRED EMBODIMENT

Figure 1:
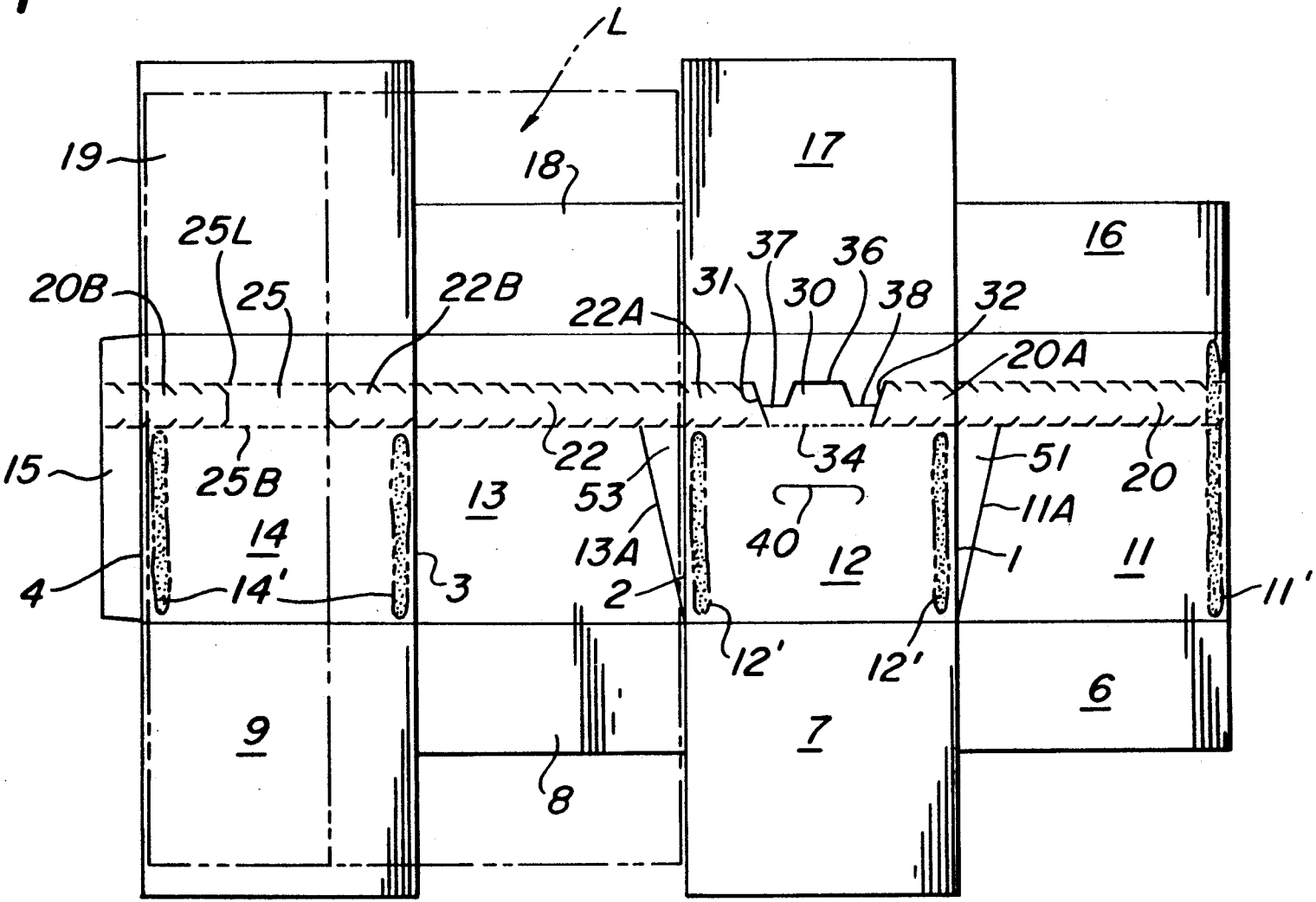
FIG. 1 is a plan view of a carton blank for use in making a carton in accordance with the invention.

The carton-type of container in accordance with the invention comprises an outer carton C and a liner L contained within the outer carton C for containing the contents of the container in a sealed condition. Outer carton C is made from a carton blank as shown in FIG. 1 and comprises a sheet of a suitable paperboard or boxboard cut and scored as shown in this figure. The blank is provided with four scores 1, 2, 3, 4 formed to extend along parallel lines to define a plurality of panels, including a side wall 14, with an attachment flap 15 hingedly connected to the outermost side edge of back wall 14. Panels 11, 12, 13 and 14 are provided with conventional bottom end closure flaps 6, 7, 8 and 9, respectively, hingedly connected along the bottom ends thereof, said closure flaps 6–9 being constructed and arranged to form the bottom closure of the carton in a conventional manner. Panels 11, 12, 13 and 14 are also provided with top end closure flaps 16, 17,18 and 19, respectively, at their top ends, said closure flaps 16–19 being constructed and arranged to form the top closure of the carton in a conventional manner.

Outer carton C is provided with means for severing the panels 11–14 along a strip spaced below the upper ends thereof and for defining a hinge portion in the back wall 14, said means being usable (after the outer carton C is formed into its box-like configuration) to divide the outer carton C into a lid LD, comprising the top of the carton and the upper portions of panels 11–14, and into a base B, comprising the bottom of the carton and the lower portions of panels 11–14, as will be described more fully hereafter. To this end, there is provided a pair of tear strips 20 and 22. Tear strip 20 is formed to extend from its one end across a portion 20A located on front wall 12, across all of side wall 11, and across a portion 20B of back wall 14 to its other end which is located adjacent a hinge portion 25 defined between a pair of spaced-apart horizontally extending perforation cut scores 25L and 25B. The other tear strip 22 is formed to extend from its one end across a portion 22A located on front wall 12 across all of side wall 13, and across a portion 22B of back wall 14 to its other end located at hinge portion 25.

Front wall 12 is provided with means for defining a reclosure tab 30. To this end, there is provided a pair of slits 31 and 32 which extend vertically across the ends of tear strips 20 and 22, respectively, located on front wall 12. The lower ends of the slits 31 and 32 are joined by a horizontally extending perforation cut 34 constructed to permit the severing of the front wall 12 along this horizontal extend to define tab 30, which extends downwardly from the upper or lid portion of the front wall 12, as will be described more fully hereafter. Tab 30 is also provided with an inverted trough-shaped cut 36, cut 36 having an upper horizontally extending portion and a pair of vertically extending portions terminating at a medial location of tab 30, from which location a pair of horizontally extending embossed lines 37 and 38 are formed to extend therefrom to said cuts 31 and 32, respectively. The trough-shaped cut 36 forms a tongue flap for use in reclosing the outer carton C in a manner to be described more fully hereafter. There is also provided an inverted trough-shaped cut 40 in front wall 12 spaced below and in alignment with the cut 36 and constructed and arranged to have the tongue portion 39 inserted therein for interlocking the upper and lower portions of panel 12 in a manner to be described hereafter.

Figure 2:
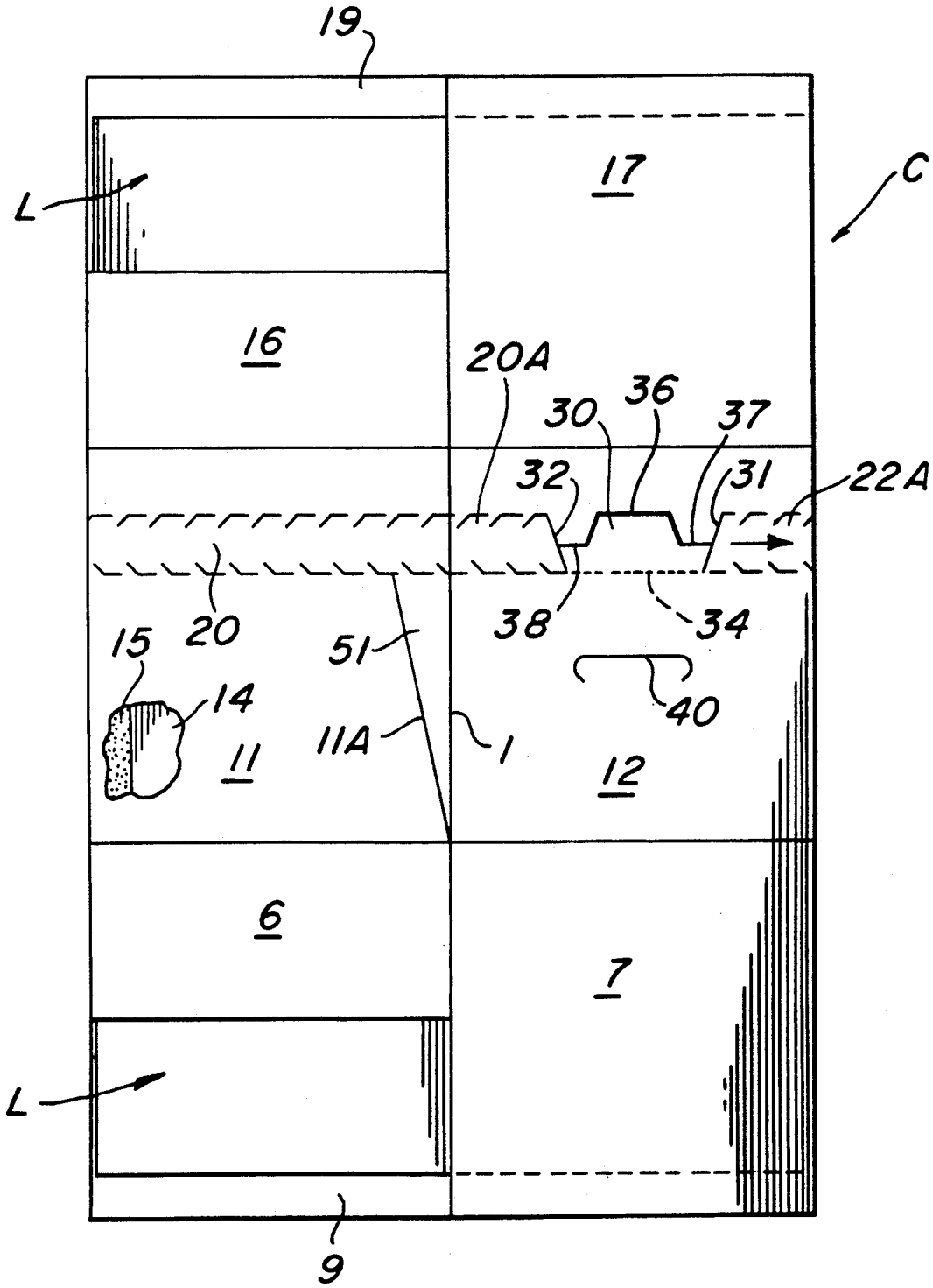
FIG. 2 is a plan view illustrating the carton blank in a flat-folded tubular condition.
Figure 3:
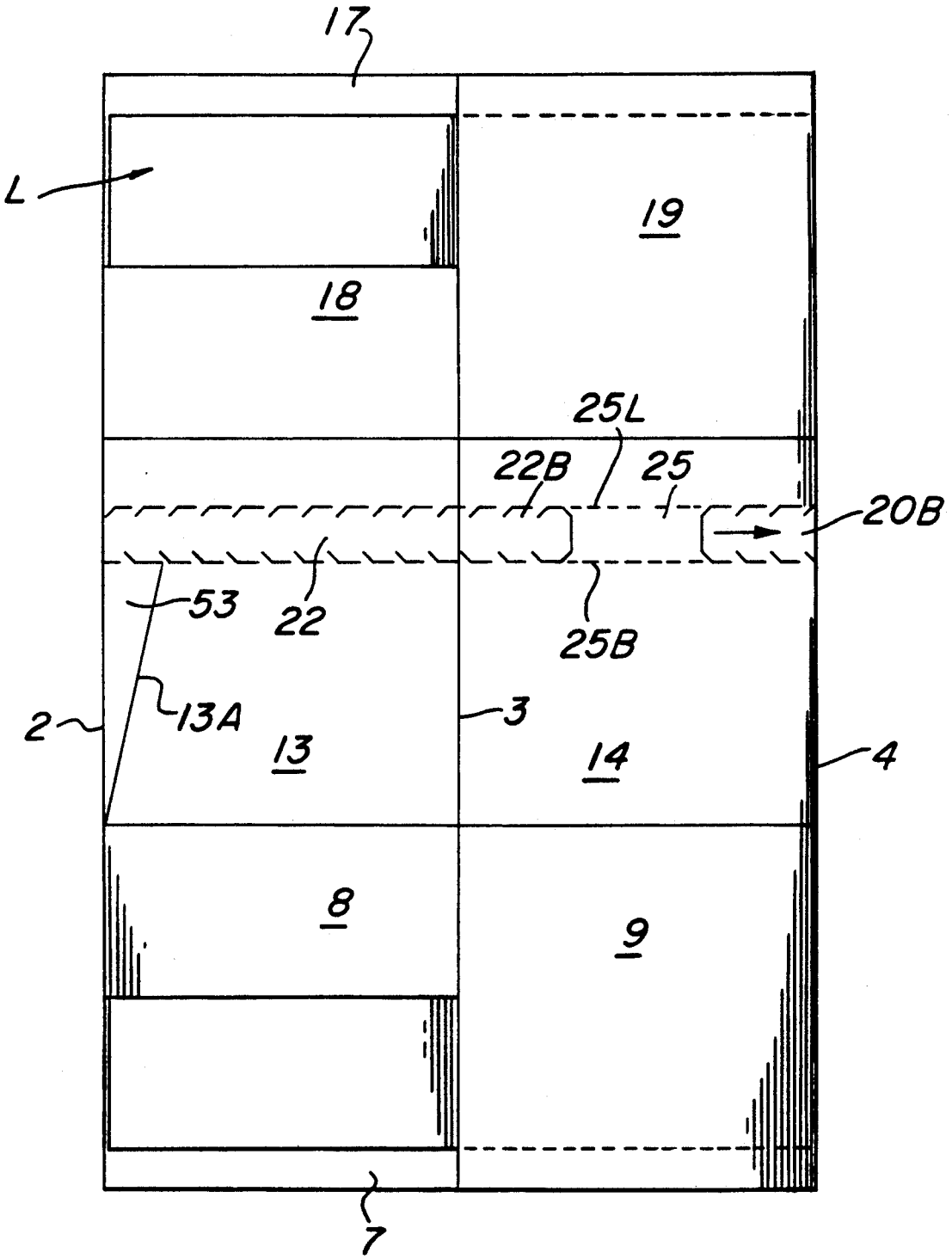
FIG. 3 is a view similar to FIG. 2 showing the other side of the carton blank in its flat-folded tubular condition.

In the making of the container 10 in accordance with the invention, the blank (shown in FIG. 1) is fabricated into a knocked-down tubular condition in accordance with conventional practice. In this procedure, utilizing conventional carton folding and gluing equipment, the carton blank as shown in FIG. 1 is fed out of a hopper to a location where adhesive is applied to the carton blank for securing the outer carton C and the liner L together in a registered condition and for interconnecting the carton blank into a tubular condition as shown in FIGS. 2 and 3. Prior to being folded over to the condition shown in FIGS. 2 and 3, the carton blank has a liner L placed thereon. Liner L is made of a moisture/vapor-proof material and is formed, sealed and cut to form a flattened tube adapted to meet with the carton blank and to be registered thereon. In addition, an odor barrier can be added to the inside or outside of Liner L. Utilizing conventional equipment, the carton blank C and liner L are handled in a manner such that the liner L is deposited on the blank and the carton blank is folded to form a structure as shown in FIGS. 2 and 3. During the folding steps, a strip of adhesive 11' is interposed between the uppermost side edge of panel 11 and the surface of attachment flap 15 contacted thereby. Also, liner L is attached in a registered position on the outer carton C by suitable adhesive strips 14' on panel 14 and 12' on panel 12. After the carton blank is folded to the condition as shown in FIGS. 2 and 3, it is passed into a compression apron whereby pressure is applied to secure the liner L to the carton blank throughout the overlapping surfaces thereof where the adhesive strips 12' and 14' are applied. Thus, liner L adheres to opposing inner surfaces of the outer carton panels 12 and 14 at the glue strips 12' and 14' that are provided.

It will be apparent that the flat-folded carton structure shown in FIGS. 2 and 3 is in condition to be shipped and stored in a flattened condition as shown in these figures. In the hands of the packager, the carton structure may be readily erected by simply squaring up the carton body walls, the carton walls 11–14 being moved into positions in which the adjacent walls lie at right angles to one another, such movement serving to automatically erect the tubular liner L as well in preparation for filling, sealing, and closing of the container.

The packager will complete the formation of the carton in accordance with the invention by adding product, sealing the liner, and closing the carton. In this carton forming procedure by the packager, the carton is inverted and the bottom end of the liner L flattened and sealed in a conventional fashion, followed by the sealing and infolding of the liner L and a concurrent infolding and securing together of the bottom closure flaps 6–9, as will be readily understood by those skilled in the art. In this procedure, the bottom closure flap 6 is provided with a strip of adhesive which is used to secure the bottom carton structure together which is contacted by the bottom flap 7 which is the last to be folded over. Various types of folding and gluing apparatus are available to form the necessary liner sealing, flap folding, and gluing operations.

Figure 4B:
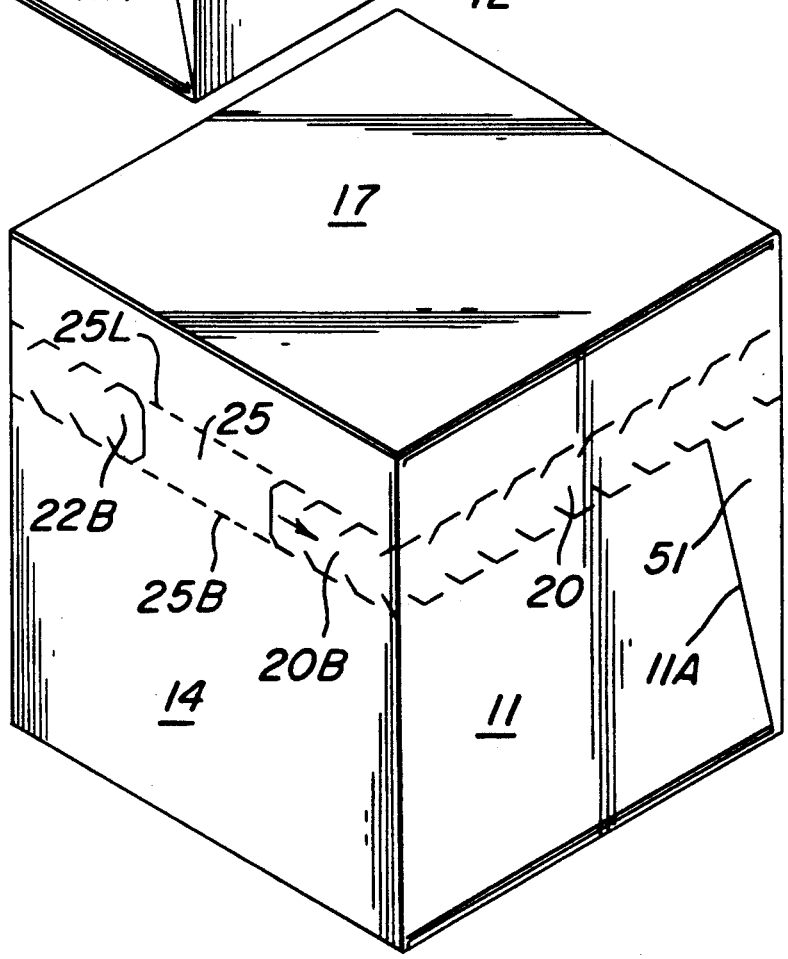

Following formation of the bottom end closure, the carton will be inverted to its normal position and the liner L is opened and filled with the desired contents, whereupon the uprighted and filled carton will be advanced to a sealing station where the top end of the liner L is sealed, the liner L is infolded, and top closure flaps 16–19 are infolded and secured in a closed condition. The top closure is also achieved in a conventional manner by equipment available in the art to form a carton closed at the top as is illustrated in FIGS. 4A and 4B. In this case, top flap 16 is provided with a strip of adhesive which is used to secure the top closure together by contact with the uppermost top flap 17 as is conventional.

The sealing of liner L and the closure of the top of the outer carton C are achieved by conventional equipment known in the art, such as those described in U.S. Pat. Nos. 2,099,257, 2,166,389, 2,979,995, 3,439,506, 4,032,060, 4,099,665, 4,236,368 and 4,838,424.

The completed carton-type container is now in the condition to be presented for sale as is illustrated in FIGS. 4A and 4B.

In the hands of the user, the carton is opened by the use of the tear strip means provided on the panels 11–14 for severing the same along a strip spaced below the uppermost ends thereof, such means defining a hinged portion in the back wall to divide the carton C into a lid LD comprising the top of the carton and the upper portions of the wall panels 11–14 and a base B comprising the bottom of the carton C and the lower portions of said walls. The construction is such that the lid LD is hingedly connected to the back wall 14 by the hinge portion 25 for movement toward and away from the base B for use in opening the top of the carton C to expose the contents thereof and for reclosing the top of the carton as desired.

The first step in opening the carton is to remove the tear strips 20 and 22.

In order to remove the tear strip 20, the user grasps the end thereof with his fingers at portion 20B adjacent hinge portion 25 and pulls the tear strip 20 outwardly and around the carton in the direction of the arrow shown in FIG. 4B to remove it from the carton structure, the end of this procedure being illustrated in FIG. 5 wherein the tear strip 20 is shown almost entirely removed. In order to remove the tear strip 22, the user grasps the end thereof with his fingers at portion 22A adjacent cut 31 (see FIG. 5) and pulls it outwardly and around the carton in the direction of the arrow shown in FIG. 5 to remove it entirely from the carton structure, the end of this procedure being illustrated in FIG. 6 wherein the tear strip 22 is almost entirely removed.

The next step is to sever the front wall 12 along the perforation cut 34 which severs the lid portion 12L of front wall 12 from the base portion 12B of front wall 12. Thus, lid LD is separated from base B around almost the entire extent of the outer carton C except for the short length of hinge portion 25. The user is now free to bend the lid LD backwardly along the hinge portion 25 to a position as shown in FIG. 7 whereby good access is provided to the top of the liner L which can then be opened up to gain access to the sealed contents therein as illustrated in this figure.

Figure 8:
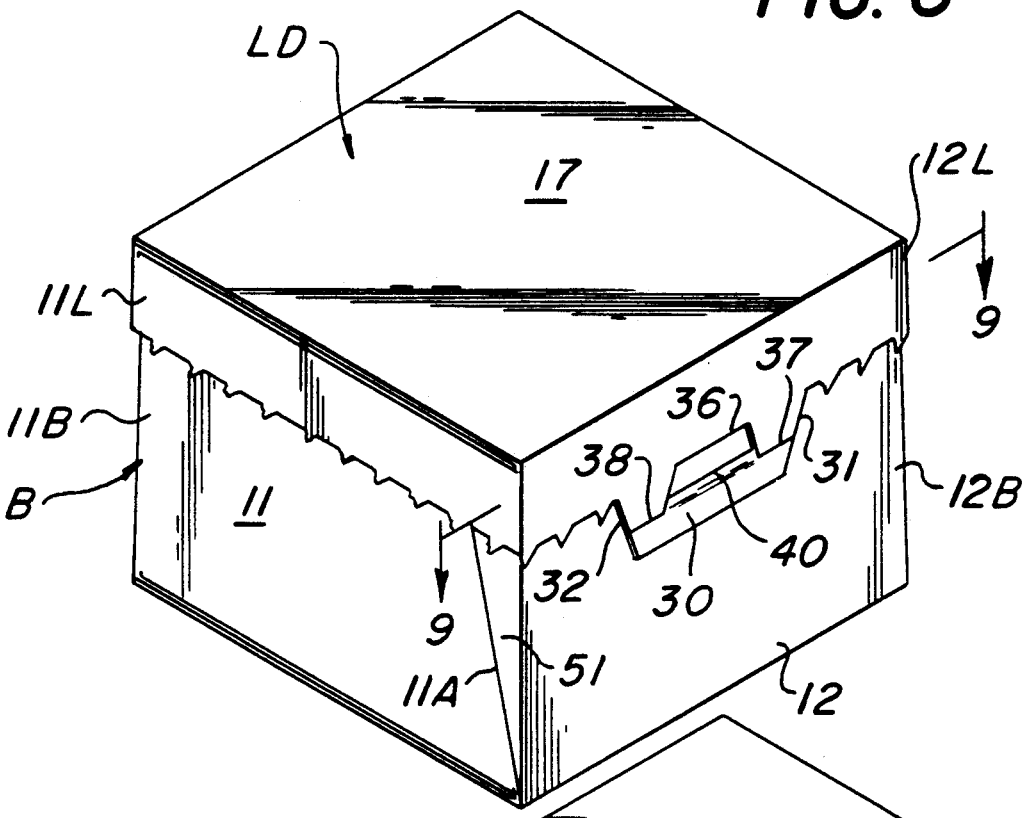
FIG. 8 is a view illustrating the carton in a reclosed condition after having been opened.

When the user desires to reclose the container after using only part of the contents, the liner L is reclosed (and possibly sealed if the structure is formed that way), and the lid LD is moved to a closed position as shown in FIG. 8. In the reclosed condition, hinge portion 25 is located inside the lid portion 14L as best shown in FIG. 10, and the tongue flap 39 of tab 30 is inserted upwardly into the slit 40 to lock the base portion 12B and lid portion 12L of the front wall 12 together as shown in FIGS. 8–10.

Each of the side walls 11 and 13 is provided with an embossed foldline 11A and 13A, respectively. Foldline 11A extends upwardly from the bottom end of side wall 11 where it joins with front wall 12 to the bottom edge of tear strip 20 to thereby form a triangular-shaped pleat 51 at the vertical edge of the front wall portion 11B of the portion of side wall 11 comprising part of the base B. Foldline 13A is formed to extend upwardly from the bottom end of side wall 13 where it joins with front wall 12 to the bottom edge of tear strip 22 to thereby form a triangular-shaped pleat 53 at the vertical edge of the front wall portion 13B of the portion of side wall 13 comprising part of the base B. By this construction, front wall portion 12B of the base B can be moved inwardly so as to receive the lid LD more easily during a re-closure operation of the top of the carton. The inward movement of the front wall portion 12B of base B is achieved by the user pushing the front wall portion 12B inwardly to cause the pleats 51 and 53 to fold inwardly as the top end of the front wall portion 12B of base B moves inwardly underneath the opposing portion 12L of the lid LD during a re-closure procedure. FIG. 9 best illustrates the inwardly folded condition of the pleats 51 and 53.

It will be noted that the glue strips 12' are located on the base portion 12B of front wall 12 and the glue strips 14' are located on the base portion 14B of back wall 14 and serve as means for attaching the liner L to the inner surface of the outer carton C. Further, because of the limited adhering areas provided by the glue strips 12' and 14', the construction is such as to permit ease of separation of the Liner L from the outer carton C whereby the liner L and the outer carton C can be separated and disposed of independently whereby the container is environmentally friendly.

It is noted that glue strips 12' and 14' are the only means by which liner L is attached to outer carton C.

It will be apparent that various changes may be made in the construction and arrangement of parts without departing from the scope of the invention as defined by the following claims. For example, in some applications, the product may be individually wrapped whereby there is no need to provide a liner, whereby the container will comprise the reclosable carton C without liner L. Other obvious changes may also be made.

We claim:

1. A reclosable carton having a box-like configuration comprising:

front and back walls in opposed relation, a pair of side walls in opposed relation, said walls being provided with bottom closure flaps at their lowermost end for forming the botton of the carton, said walls being provided with top closure flaps at their uppermost ends for forming the top of the carton, and means for severing said front wall and said end walls along a strip placed below the uppermost ends thereof to define a hinge portion in said back wall and to divide said carton into a lid comprising the top of the carton and the uppermost portions of said walls and a base comprising the bottom of the carton and the lower portions of said walls, said lid being hingedly connected to said back wall by said hinge portion for movement toward and away from the base for use in opening the top of the carton to expose the contents thereof and for reclosing the top of the carton, said wall severing and hinge defining means comprising a pair of tear strips, one of said tear strips being formed to extend from its one end located at said front wall across one of said side walls and across a portion of the back wall to its other end located at said hinge portion, the other of said tear strips being formed to extend from its one end located at said front wall across the other of said side walls and across a portion of said back wall to its other end located at said hinge portion.

2. A carton according to claim 1 wherein said hinge portion is defined by a first score line extending across the bottom of said lid and a second score line extending across the top of said base, said hinge portion being hingedly connected to said lid at said first score line and being hingedly connected to said base at said second score line.

3. A carton according to claim 1 wherein each of said side walls has a foldline formed therein extending upwardly from the bottom end thereof where said side walls join with said front wall to form triangular shaped pleats at the vertical edges of said front wall portion of said base whereby said front wall of said base can be moved inwardly so as to receive said lid more easily during the closure of the top of the carton.

4. A carton according to claim 1 wherein the ends of said tear strips located on said front wall are joined by a tear line extending across the top of said base of said carton to define a reclosure tab extending downwardly from said lid, and including a slit portion formed in said front wall at a location of said base so as to be interlocked with a portion of said reclosure tab.

5. A carton according to claim 4 wherein said reclosure tab has a cut-out forming a tongue portion configured to extend upwardly toward the top of the carton, said tongue portion being constructed and arranged to be inserted into said slit portion in said front wall of said base for interlocking said tab portion of said lid with said front wall of said base.

6. A carton according to claim 1 including a liner contained within said carton and means for attaching said liner to the inner surface of said carton in a manner to permit ease of separation of said liner from said carton for the separate disposal thereof.

7. A carton according to claim 6 wherein said means for attaching said liner to said carton comprises glue strips located to attach said liner to at least two walls of said base.

* * * * *